US005090669A

United States Patent [19]

Pieroni

[11] Patent Number: 5,090,669

[45] Date of Patent: Feb. 25, 1992

[54] PIN TABLE

[75] Inventor: Robert J. Pieroni, Youngstown, N.Y.

[73] Assignee: Eastman Machine Company, Buffalo, N.Y.

[21] Appl. No.: 625,944

[22] Filed: Dec. 11, 1990

[51] Int. Cl.[5] ..... B23Q 3/18

[52] U.S. Cl. ..... 269/54.5; 83/939

[58] Field of Search ..... 269/53, 54.4, 54.5, 269/54.1, 289 R, 292; 83/451, 925 CC, 939

[56] References Cited

U.S. PATENT DOCUMENTS

| | | | |
|---|---|---|---|
| 1,806,887 | 5/1931 | Bruno | 264/54.5 |
| 4,822,015 | 4/1989 | Glasman et al. | 269/54.5 |
| 4,832,323 | 5/1989 | Principe et al. | 269/54.5 |

*Primary Examiner*—Robert C. Watson

*Attorney, Agent, or Firm*—Hodgson, Russ, Andrews, Woods & Goodyear

[57] ABSTRACT

A method and apparatus for supporting sheet material such as cloth during operations thereon such as cutting wherein a pattern is placed on a supporting surface provided with a plurality of pins extending through apertures in the surface, the pins are lowered below the surface for removal of the pattern whereupon sheet material is placed on the surface, typically a plurality of plies being layed up in a stack, and simultaneously the pins are moved through the sheet material to maintain alignment and matching of the plies in the stack. The pattern then is placed on the sheet material in a position determined by the location of the pins, and the material is shaped such as by cutting.

A plurality of separate pin holding and supporting devices, each of relatively narrow width, are provided in spaced relation lengthwise along the apparatus and are independently movable lengthwise toward and away from each other. Each pin holding and supporting device includes a pin contacting component wherein a pin contacting surface is defined by a member mounted for limited movement and wherein another pin contacting surface is provided with a wear resistant coating. There is also provided an arrangement for moving the supporting devices to move the pins through the apertures between a position where the heads of the pins are spaced below the supporting surface and a position where the pins extend through the apertures and the heads of the pins are above the supporting surface so that the sheet material can be anchored thereon.

7 Claims, 2 Drawing Sheets

Fig. 3.
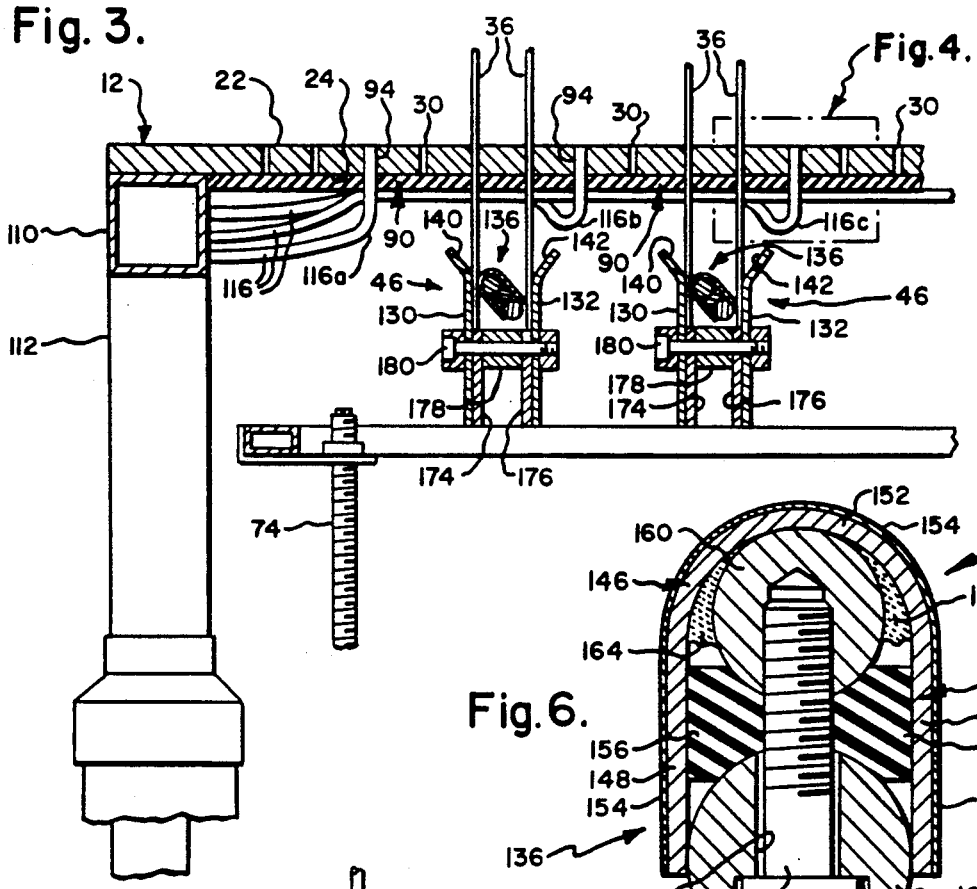
Fig. 4.
Fig. 6.
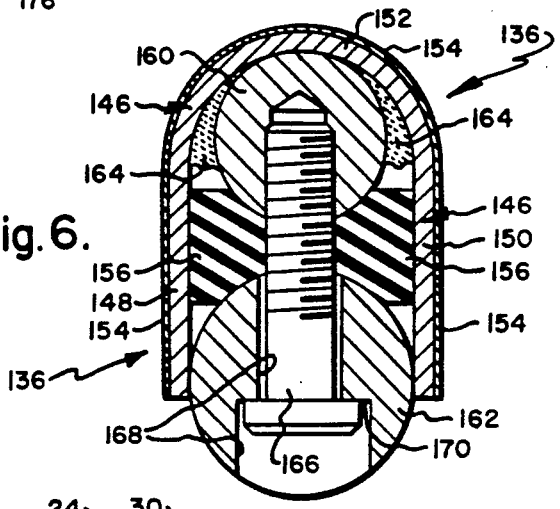
Fig. 4.
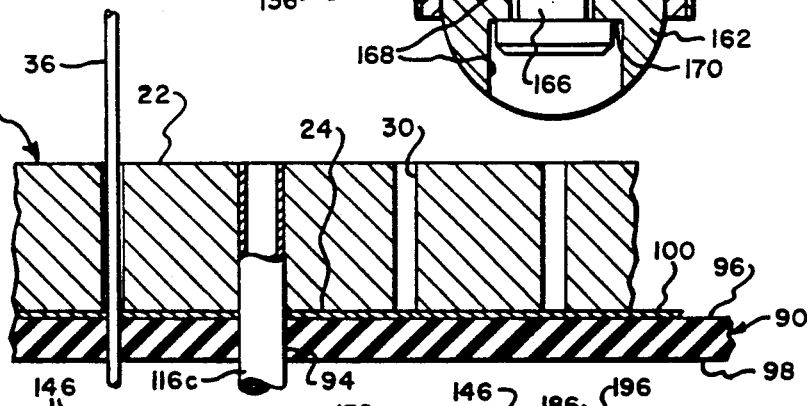
Fig. 5.
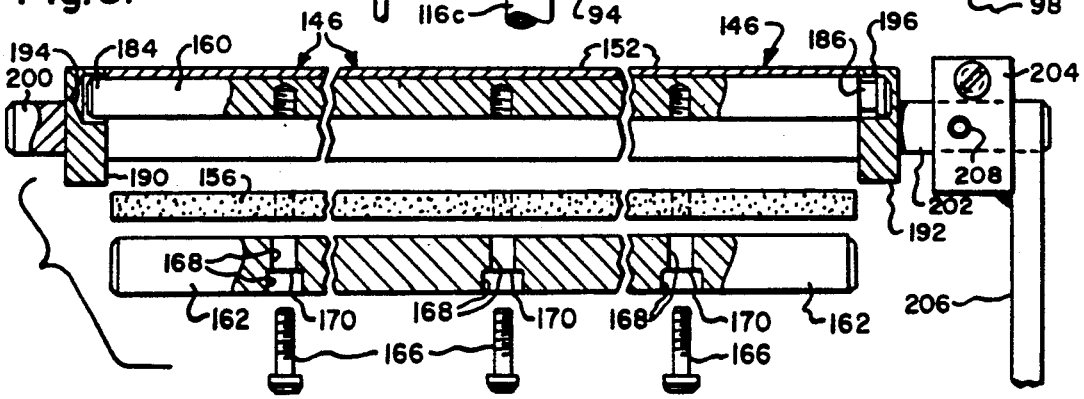

PIN TABLE

BACKGROUND OF THE INVENTION

This invention relates to the art of apparatus for performing operations such as cutting sheet material like cloth, and more particularly to a new and improved pin table for supporting and matching sheet material during such operations.

One area of use of the present invention is supporting and matching patterned sheet material in a stack for cutting a pattern from the stack, although the principles of the present invention can be variously applied. The matching of plaids, stripes and checked fabrics has been an expensive and difficult manual process for apparel manufacturers with stringent quality matching requirements. Problems can occur because the panels making up a garment must be correctly matched, and the pattern of each panel must be in the correct position in order for the whole garment to match perfectly. Furthermore, distortion in the fabric sometimes causes the size of the check or pattern to differ and stripes are not always straight. One proposed solution to the foregoing is known in the art as a pin table.

It would, therefore, be highly desirable to provide an improved apparatus for supporting and matching patterned sheet material during operations performed thereon, in particular for supporting and matching patterned cloth in a stack for cutting a pattern therefrom, resulting in labor and material savings and improved quality. It would be desirable to provide the foregoing in a new and improved pin table, and wherein such pin table optimizes matching of the grid pattern of the pins to plaid pattern fabrics of any size plaid. Furthermore, it would be advantageous to provide the foregoing along with the capability of moving the stacked sheet material along the supporting surface in a pin table of relatively simple structure.

SUMMARY OF THE INVENTION

It is, therefore, a primary object of this invention to provide a new and improved apparatus for supporting and matching patterned sheet material during operations thereon such as cutting.

It is a further object of this invention to provide such an apparatus for supporting and matching patterned sheet material such as cloth in a stack for cutting a pattern from the stack.

It is a more particular object of this invention to provide the foregoing in a new and improved pin table.

It is a more particular object of this invention to provide such a pin table which optimizes matching of the grid pattern of the pins to plaid pattern fabrics of any size plaid.

It is a further object of this invention to provide such an apparatus having the capability of moving the stacked sheet material along the supporting surface.

It is a further object of this invention to provide such a pin table which is economical to manufacture, effective and efficient in operation, and which results in labor and material savings and improved quality.

The present invention provides apparatus for supporting sheet material such as cloth during operations thereon such as cutting wherein a pattern is placed on a supporting surface provided with a plurality of pins extending through apertures in the surface, the pins are lowered so that the heads are below the surface for removal of the pattern whereupon sheet material is placed on the surface, typically a plurality of plies being layed up in a stack, and simultaneously the pins are moved through the sheet material to maintain positioning thereof on the surface, i.e. to maintain alignment and matching of the plies in the stack. The pattern then is placed on the sheet material in a position determined by the location of the pins, and the material is shaped such as by cutting.

The apertures are arranged in closely-spaced relation in a grid-like pattern on the supporting surface, and the apparatus includes holding and supporting means for receiving the pins at the ends opposite the sharp heads thereof and holding the pins substantially perpendicular to the supporting surface and locating the heads in registry with the apertures. A plurality of separate pin holding and supporting means, each of relatively narrow width, are provided in spaced relation lengthwise along the apparatus and are independently movable lengthwise toward and away from each other. As a result, pins of adjacent rows can be closely spaced together thereby achieving a grid pattern wherein the pins are relatively closely spaced. This, in turn, optimizes matching the grid pattern of pins to fabric patterns. There is also provided means for moving the supporting means to move the pins between a position where the heads of the pins are spaced below the supporting surface and a position where the heads of the pins are above the supporting surface so that the sheet material can be anchored thereon.

The pin table further comprises means for developing a positive pressure to apply a flotation force to sheet material on the surface to facilitate movement of the material along the surface. In particular, there is provided manifold means connected to a source of positive pressure, a plurality of openings in the supporting surface, fluid sealing means for sealing the apertures while allowing pins to be moved therethrough, and means for connecting the manifold means to the openings to supply positive pressure to the openings for applying a flotation force to sheet material on the surface.

The foregoing and additional advantages and characterizing features of the present invention will become clearly apparent upon a reading of the ensuing detailed description together with the included drawing wherein:

BRIEF DESCRIPTION OF THE DRAWING FIGURES

FIG. 3 is an enlarged, sectional view taken about on lines 3—3 in FIG. 1;

FIG. 4 is an enlarged fragmentary elevational view taken about in the field designated by the broken lines in FIG. 3;

FIG. 5 is a developed fragmentary longitudinal sectional view of a pin holding and supporting means in the apparatus of FIG. 1; and FIG. 6 is an enlarged cross-sectional view of the pin holding and supporting means of FIG. 5.

DETAILED DESCRIPTION OF THE ILLUSTRATED EMBODIMENT

Figure 1:
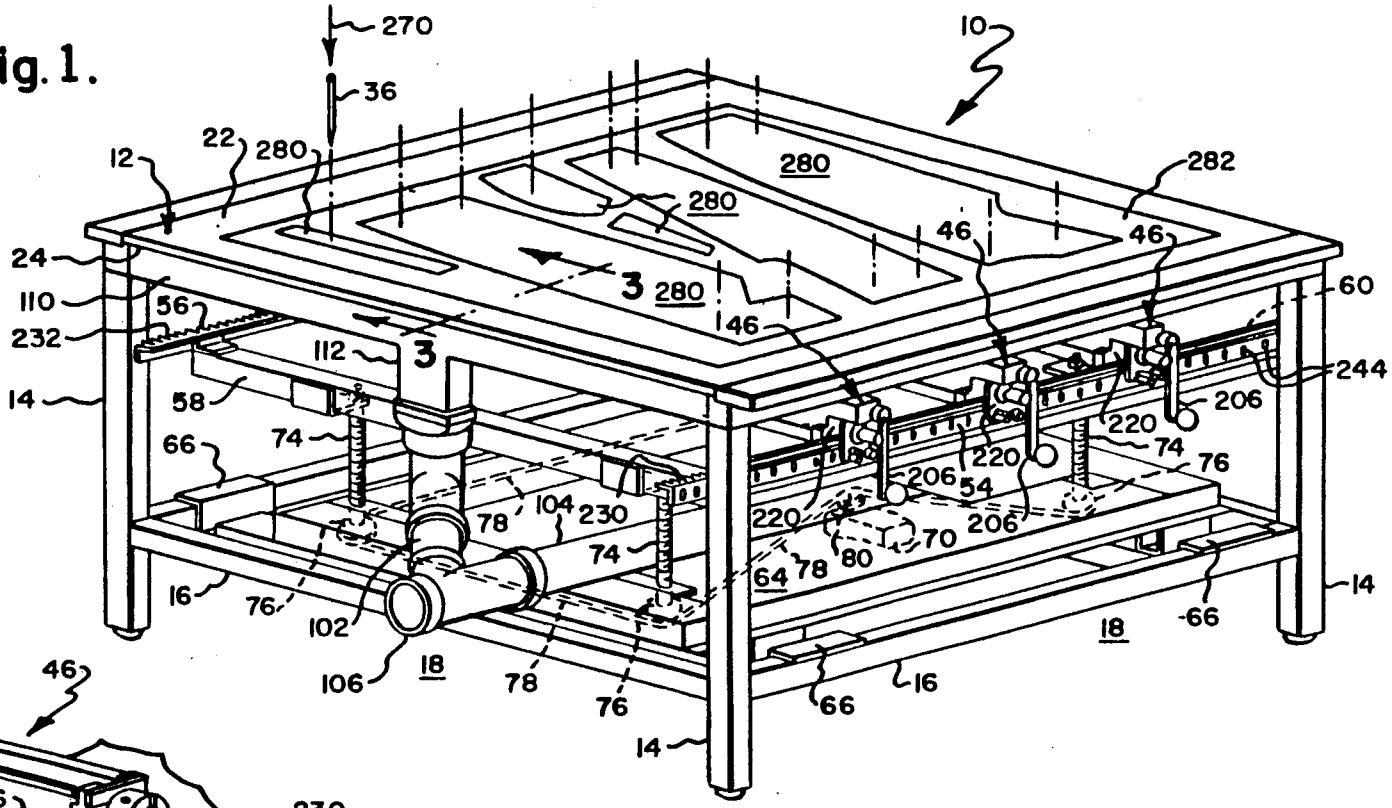
FIG. 1 is a perspective view of a pin table according to the present invention.

Referring now to FIG. 1, the apparatus of the present invention includes a table generally designated 10 comprising a supporting frame and means on the frame defining a planar supporting surface 12 adapted to receive sheet material, such as cloth, placed thereon. A single pin table 10 of the present invention is shown in FIG. 1. If desired a plurality of tables 10 can be joined end-to-end to provide an elongated combined table of desired length. Table 10 comprises frame members including upstanding legs 14 at each corner joined by horizontal legs 16 whereby the table 10 is supported on a suitable surface such as a floor 18 as shown in FIG. 1.

The means 12 defining a planar supporting surface is in the form of a sheet of rigid material supported in the frame and disposed substantially parallel to the floor 18 or similar supporting surface on which the table 10 rests. Sheet 12 has an outer surface portion 22 for contacting the sheet material placed thereon and an oppositely disposed inner surface portion 24. As shown in FIG. 3 sheet 12 is provided with a plurality of through apertures or bores 30 which are arranged in closely spaced relation and in a grid-like pattern. The apertures 30 are for the purpose of receiving and guiding pins such as the pins designated 36 in FIGS. 1 and 3, which pins are employed for matching of patterns in respective sheets of material and in relation to the pattern for shaping or cutting in a manner which will be described.

The apparatus of the present invention further comprises means carried by the frame for holding and supporting the aforementioned pins 36. Each of the pins 36 has a sharp head at one end and an opposite end, and the supporting means receives the pins at the opposite ends. The supporting means maintains the disposition of the pins 36 substantially perpendicular to the plane of sheet 12 and maintains the location of the pins in registry with the apertures 30. As shown in FIG. 1, a plurality of pin holding and supporting means, each designated 46, are provided in spaced relation along table 10. Each holding and supporting means 46 extends transversely across and along substantially the entire width of table 10. Each can hold a plurality of pins 36 in a row extending across table 10. By virtue of this arrangement, pins of adjacent rows advantageously can be closely spaced together thereby achieving a one-inch grid pattern in an effective manner which will be described. The structure and operation of the individual pin holding and supporting means will be described in detail presently.

The apparatus of the present invention further comprises means for moving the plurality of holding and supporting means 46 to move the pins 36 carried thereby through the apertures 30 in sheet 12 between a position where the heads of the pins are below the sheet outer surface 22 to a position where the heads of the pins are above surface 22 so that sheet material can be anchored on the pins. In particular, as shown in FIG. 1, the holding and supporting means 46 are supported in an auxiliary frame comprising a pair of spaced apart and parallel longitudinally extending frame sections 54, 56 on which opposite ends of each holding and supporting means 46 rest. The ends of the holding and supporting means 46 are supported on frame sections 54,56 in a manner permitting limited movement of each holding and supporting means 46 lengthwise along table 10 as will be described. The longitudinal frame sections are joined by a pair of laterally extending frame sections 58, 60 located near opposite ends of table 10. A base generally designated 64 is fixed to the horizontal legs 16 of the table frame by means of brackets 66. There is provided drive means in the form of a drive motor 70 fixed to base 64 so as to be carried thereby and coupling means operatively connected to drive motor 70 and to means associated with frame sections 54, 56 for raising and lowering the pin holding and supporting means in response to operation of drive motor 70. In particular, there is provided a screw jack arrangement comprising four vertically disposed threaded screws 74 each threaded at one end to a coupling member on a corresponding frame section 54, 56 and each fixed near the opposite ends to sprockets 76 which, in turn, mesh with a continuous drive chain 78 operatively engaged by a gear 80 on the output shaft of motor 70. As a result, rotation of motor 70 in one direction raises the plurality of pin holding and supporting means 46 and rotation of motor 70 in the opposite direction lowers the pin holding and supporting means 46. A manually operated-control (not shown) is located on the table frame for convenient manipulation by persons using table 10 to control operation of motor 70.

The pin table 10 of the present invention advantageously has the capability of applying a floatation force to sheet material on the surface thereof to facilitate movement of the material along the surface without the need for a large pressure chamber below the table surface. As previously described, the pin table top is in the form of a plate or sheet 12 which defines a planar supporting surface adapted to receive plies of sheet material placed thereon, and the surface has an outer portion 22 for contacting the material and an oppositely disposed or inner portion 24. There is provided fluid sealing means 90 operatively associated with the pin table supporting surface for preventing fluid flow through the pin - receiving apertures 30 in a direction from the outer surface portion 22 to the oppositely disposed inner portion 24 while allowing the pins to extend therethrough, and means for applying positive pressure to the region or space between the outer surface portion 22 and the sheet material thereon. In particular, there is provided a plurality of openings or passages 94 extending through the table top surface and through the sealing means 90 and at spaced locations over the surface, and means on the pin table frame for supplying positive pressure to the openings 94 to apply a flotation force to sheet material on the table top surface to facilitate movement of the sheet material along the surface The positive pressure in openings 94 is applied to the space between outer surface portion 22 and the sheet material thereon, and sealing means 90 prevents any loss of this positive pressure through the pin-receiving apertures 30.

Sealing means 90 preferably comprises a sheet of rubber or like material extending along the oppositely disposed surface portion 24 in a manner blocking or covering apertures 30 to prevent fluid flow through the apertures. In this connection, the objective is to prevent fluid flow through apertures 30 in a direction from supporting surface portion 22 to oppositely disposed surface portion 24. Furthermore, the material of sealing means 90 allows the pins to extend therethrough, and in particular to be manually pushed therethrough by the operator with little additional effort, while at the same time maintaining its fluid sealing capability. In particular, sealing means 90 maintains a fluid seal around a pin inserted therethrough, and it re-seals the area therein from which a pin is removed. The sheet of material comprising sealing means 90 has a first surface portion 96 as shown in FIG. 4 contacting surface portion 24 in sealing relation thereto and a second surface portion 98 which is exposed and faces in the opposite direction.

Sealing means 90 is secured in place preferably by adhesive 100 extending over the entire contact area between surface portion 96 thereof and surface portion 24 of sheet 12. One form of material found to perform satisfactorily for sealing means 90 is an open cell foam rubber material having a sealed outer skin and commercially available from Griswald Rubber Co., Moosup, Conn. under the designation Griswald Style #3120 blended open cell sponge, medium density, neoprene blend. One form of adhesive 100 found to perform satisfactorily is 3M General Purpose Adhesive 1357.

The means for supplying positive pressure to the region or space between outer surface 22 of table top 12 and sheet material placed thereon includes a source of positive pressure in the form of a compressor/air blower (not shown) which can be mounted with the pin table or, alternatively, and as shown in FIG. 1, a single source or compressor/air blower can be provided for supplying positive pressure through a network of branch conduits to a plurality of pin table sections arranged in end-to-end relation. As shown in FIG. 1, table 10 is provided with a pair of branch conduits 102, 104 for supplying pressure to opposite ends of table 10 for a purpose to be described which meet in a single conduit section 106 for connection either directly to a compressor/air blower or to a conduit of the aforesaid network.

The means for connecting the output of the positive pressure source to the region or space between outer surface 22 of the table top and material placed thereon includes manifold means associated with the pin table frame, means for connecting the output of the source to the manifold means, and conduit means connected to the manifold means and to each of the openings 94. In a preferred arrangement, a pair of manifolds is provided, one at each end of pin table 10, and a pair of supply ducts or pipes connect the output of the source to the manifolds. One of the manifolds is shown in FIGS. 1 and 3 and is generally T-shaped having an elongated hollow rectangular body 110 which extends along a major portion of the upper end of table 10 and is defined by a section of the pin table frame. The manifold body 110 is located along the underside of table top 12 and terminates at each end adjacent the upper ends of two of the vertical frame members of legs 14. An inlet tube 112 extends from the central portion of body 110 for connection to one of the supply pipes, i.e. branch conduit 102.

The conduit means comprises a plurality of tubes 116 shown in FIG. 3, preferably of flexible material, each fitted at one end into an opening in a wall of manifold body 110 and fitted at the other end into one of the openings 94. The tubes 116 are arranged in groups corresponding to rows of the openings 94 and can be bundled together by appropriate ties or brackets holding the groups close to or in contact with the underside of table top 12. Similarly, the openings in the wall of manifold body 110 are arranged in corresponding groups. Tubes 116 preferably are of plastic material, preferably soft polyurethane material because of its sealing properties. The ends of three tubes 116*a*, 116*b* and 116*c* are shown in FIG. 3 and extend along the entire lengths of openings 94 and terminate at the outer surface 22 of table top 12.

The arrangement illustrated in FIGS. 1 and 3 occupies one-half of the table top 12 being located on the underside thereof. An identical arrangement of manifold openings and tubes is provided on the other half of table top 12, being located on the underside thereof.

The pin holding and supporting means 46 are shown in further detail in FIGS. 2, 3, 5 and 6. As previously described, a plurality of pin holding and supporting means 46 are in spaced relation along the length of table 10, and each holding and supporting means 46 extends transversely across substantially the entire width of table 10 for holding a plurality of pins 36 in a row extending across table 10. In the illustrated arrangement, each holding and supporting means 46 holds two rows of pins as shown in FIG. 3, and the spacing between the two rows of pins in each holding and supporting means 46 is equal to the minimum spacing between adjacent rows of pins 36 of adjacent pin holding and supporting means 46.

By virtue of the foregoing arrangement of separate pin holding and supporting means 46, pins 36 of adjacent rows can be closely spaced together thereby achieving a grid pattern wherein the pins are relatively closely spaced. This, in turn, optimizes matching the grid pattern of pins to plaid pattern fabrics of any size plaid. The arrangement of the present invention, wherein each individual pin holding and supporting means is of relatively narrow width, enables a one inch grid pattern to be achieved. A one inch grid pattern of pins 36 assures that the pins 36 will reach the match points of the plaids, and with such a pattern the plaid fabric can be moved one-half inch in either direction and the match points still will reach the pins 36. In the particular arrangement illustrated herein, the two rows of pins 36 in each holding and supporting means 46 are spaced one inch apart, and each of the rows, in turn, will be spaced one inch from the adjacent row of pins 36 on an adjacent holding and supporting means 46 when the two are in abutting relation.

Each holding and supporting means 46 includes an elongated housing including a pair of sidewalls 130, 132 which define an open top and a pin contacting means 136 between the sidewalls and movable between a first position wherein pins 36 are loosely held between the contacting mans 136 and corresponding one or both of the sidewalls 130, 132 and a second position wherein the pins 36 are tightly held or clamped between the pin contacting means 136 and the corresponding sidewall. Sidewalls 130 and 132 have outwardly diverging ends 140 and 142, respectively, as shown in FIG. 3 to facilitate entry or insertion of pins between the sidewall and pin contacting means 136.

Each pin contacting means 136 is elongated and journalled at opposite ends for pivotal movement about an axis parallel to the longitudinal axis of the holding and supporting means 46. As shown in FIGS. 3 and 6, each pin contacting means 136 includes an elongated housing 146 of U-shaped cross-section including spaced-apart sidewalls 148, 150 joined by a curved central web section 152. Housing 146 has a length slightly less than the length of the sidewalls 130, 132. The outer surface of housing 146 is provided with a strength enhancing coating 154 of chrome or like material for reasons which will be described. An elongated strip or bar 156 of rubber or like resilient material is located within housing 146 and contacts the facing inner surfaces of sidewalls 148, 150. A pair of rods 160, 162 are fitted in corresponding open regions extending along the assembly defined by the opposite side surfaces of strip 156 and the inwardly facing surface portions of housing 146. One of the rods, for example rod 160, is of smaller diameter and fixed to housing 146 such as by welds 164. The other of the rods, for example rod 162, has a diameter substantially equal to the distance between the inner surfaces of sidewalls 148, 150 and is movably held in the assembly so as to be slidable within housing 146 in a direction substantially perpendicular to the longitudinal axis thereof for a purpose to be described. In this connection, a plurality of screws 166 are secured in rod 160 at axial locations there along and extend loosely through transverse bores 168 in rod 162 with the screw heads engaging shoulders 170 defined in the bores to hold rod 162 in the assembly and to limit the extent of movement of rod 162. The spacing between sidewalls 130, 132 is maintained by a pair of internal plates 174, 176 contacting the inner surfaces of sidewalls 130, 132 and a series of spacers 178 between the plates 174, 176 held in place by bolt and nut type fasteners.

The fixed rod, i.e. rod 160, has a length greater than that of the overall assembly thereby providing extending ends 184 and 186 shown in FIG. 5 which are fixedly mounted in corresponding blocks 190 and 192 having recesses 194 and 196, respectively. Block 90 has a short shaft portion 200 which is rotatably connected in an upwardly extending supporting frame portion (not shown). Block 192, on the other hand, has a relatively long shaft portion 202 which is mounted in the body of a handle 204 and having a grip 206. Handle 204 is fixed by a set screw 208 and pivoting of handle 204 moves the pin contacting means 136 between pin locking and pin releasing positions as will be described.

Figure 2:
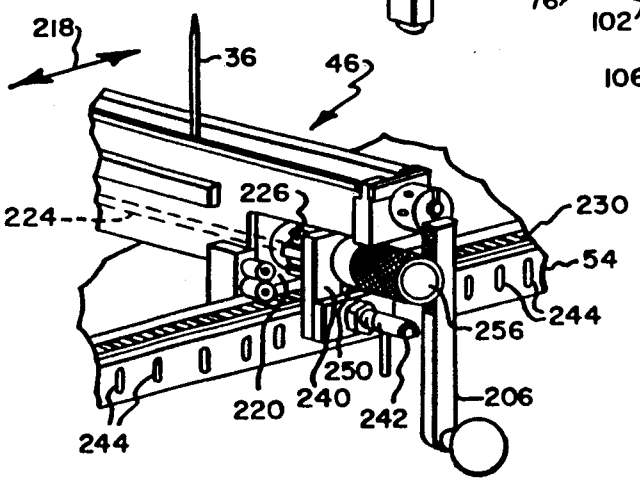
FIG. 2 is a fragmentary, enlarged perspective view of a portion of the apparatus of FIG. 1.

There is provided means for mounting the pin holding and supporting means 46 each for a limited amount of bi-directional movement along the longitudinal axis of pin table 10, i.e. in the direction of arrow 218 in FIG. 2. Each pin holding and supporting means 46 includes a pair of depending end walls, one designated 220 in FIGS. 1 and 2, provided with aligned apertures (not shown), respectively, through which a shaft 224 extends so as to be rotatably mounted therein. Shaft 224 is parallel to the longitudinal axis of the pin supporting and holding means 46 of which it is a part. The axis of shaft 224 is parallel to the axis of rods 160 and 162. First and second pinions, one designated 226 in FIG. 2, are fixed to shaft 224 adjacent opposite ends thereof and mesh with corresponding first and second racks 230 and 232, respectively, which extend parallel to the longitudinal axis of pin table 10 and are mounted on frame members 54 and 56, respectively. Thus, the arrangement of shaft 224, the pinions and the racks 230, 232 allows limited movement of each pin holding and supporting means 46 in both longitudinal directions along pin table 10, i.e. toward and away from each neighboring and adjacent pin supporting and holding means 46. Accordingly, the distance between pins of adjacent pin holding and supporting means, and thus the spacing of the grid pattern, can be adjusted. The narrow width profile of each of the pin supporting and holding means 46 enables a relatively closely spaced grid pattern, i.e. as small as one inch, to be established. Furthermore, each pin holding and supporting means 46 is releasably locked at selected spaced locations along table 10 by an arrangement including a depending end member or flange 240, the lower end of which contacts the outer surface of frame 54 and is provided with a spring-biased plunger 242 which selectively locks in spaced apertures 244 in frame 54 extending along the length of table 10.

End member 240 is provided with a central vertical slot 250 to accommodate an extension (not shown) of shaft 224 which projects outwardly beyond end member 240 to receive a handle locking member or sleeve 256 having a cylindrical outer wall and an end wall facing end number 240. Shaft 224 is rotatably received in an aperture in the end wall of locking sleeve 256 offset from the longitudinal axis of the sleeve so as to provide an eccentric mounting of locking sleeve 256 on shaft 224. Locking sleeve 256 is slidable on shaft 224 between axial limits established by a washer (not shown) fixed by a screw (not shown) to the end of shaft 224 and by the outer surface of end member 240. Handle 206 is locked by the position of locking sleeve 256 shown in FIG. 2, this being enhanced by frictional engagement between a knurled edge of handle 206 and the knurled outer surface of locking sleeve 256. When it is desired to move handle 206 to the unclamped position of the pin contacting means 136, locking sleeve 256 is moved by hand axially inwardly of the position shown in FIG. 2 toward member 240 until it no longer contacts handle 206 whereby handle 206 is movable to the unlocked position of pin contacting means 136. The foregoing arrangement for releasably locking pin contacting means 136 is similar in structure and operation to that shown and described in co-pending U.S. patent application Ser. No. 07/408,706 filed Sept. 18, 1989 entitled "Pin Table" and assigned to the assignee of the present invention, the disclosure of which is hereby incorporated by reference.

The pin table 10 of the present invention is used in the following manner for supporting and matching patterned sheet material during shaping operations such as cutting. First, a pattern is placed on surface 12. For example, when cutting operations are to be performed on the sheet material, the pattern provides the outline around which the pieces or part are to be cut. The pin holding and supporting means 46 are positioned or spaced relative to each other, i.e. moved toward or away from each other along table 10, according to the requirements of the pattern and the cutting operation. Matching scales (not shown) on the table top 12 and the frame supporting the pin holding means 46 aid in aligning the individual means 46 with the apertures 30. The next step comprises inserting pins 36 into apertures 30, the number and arrangement of pins 36 being determined by the pattern. The pins are inserted manually through the pattern in the direction as shown by arrow 270 in FIG. 1, the blunt ends being received in the pin holding and supporting means 46 as shown in FIG. 3 and the sharp end or heads of the pins being located outwardly of, i.e. above, surface 12. The pins are maintained in this arrangement or pattern during subsequent steps in the operation.

In particular, during manual insertion of pins 36, the pin contacting means 136 is in a pin receiving position such as that shown in FIG. 3 wherein the pins 36 can be readily manually inserted between the outer surface of pin contacting means 136 and the inner surfaces of sidewalls 130, 132 as seen in FIG. 3. In this first position of pin contacting means 136 the pins 36 are releasably held in the pin holding and supporting means 46. After the pins 36 are inserted in the holding and supporting means 46, the pin contacting means 136 is moved to a second position where the pins 36 are firmly clamped in the holding and supporting means. In particular, handle 206 is manually operated to pivot pin contacting means 136 about its longitudinal axis in a first direction, i.e. counter-clockwise as viewed in FIG. 3, to a position where end surface 152 and the laterally opposite outer exposed surface of rod 162 bear tightly against pins 36 and the inner surfaces of the corresponding sidewalls 130 and 132. During this clamping operation, rod 162 is forced inwardly against the resiliency of strip 156, the rod 162 being mounted for limited slding movement within housing 150. In this connection, rod 162 fits snuggly but movably within housing 150, its inward movement is limited by strip 156 and its outward movement is limited by the heads of screws 166 engaging shoulder 170. When it is desired to unclamp pins 36 so that they can be removed manually from the pin holding and supporting means 46, handle 206 is manually operated to pivot pin contacting means 136 about its longitudinal axis in a second, opposite direction, i.e., clockwise as viewed in FIG. 3, to a position such as that shown in FIG. 3 where the pins 226 are released held in the supporting and contacting means 46. In this position, end surface 152 and the outer surface of rod 162 bear loosely against pins 36 and the inner surfaces of sidwalls 130, 132. During repeated clamping and unclamping operations of pin contacting means 136, surface 152 is protected against wear by coating 154.

The foregoing operation occurs for each pin holding and supporting means 46. In this connection, two rows of pins 36 can be inserted in each holding and supporting means 46 as shown in FIG. 3 or, alternatively, only one row of pins can be inserted in each holding and supporting means 46, this being determined by the nature of the pattern being shaped. Next, the pins 36 are moved vertically downwardly as viewed in FIGS. 1 and 3 by moving the supporting frame 54, 56, 58 as previously described. During such movement the pins 36 are maintained in the arrangement. Such movement pins 36 places the sharp ends therof at or below surface 12 whereupon the pattern is removed.

The next step in the operation is placing sheet material on surface 12 while moving pins 36 through the sheet material to maintain positioning of the sheet material on surface 12. Pins 36 are moved upwardly vertically relative to surface 12. Typically the step comprises laying up a plurality of plies of sheet material on the surface 12 to provide a stack while moving pins 36 progressively upwardly through the stack to maintain alignment and matching of the plies in the stack. Upon completion of placing sheet material on the surface 12, the pattern is placed on the sheet material in a position determined by the location of pins 36, i.e., the pattern is placed on the exposed sharp ends or heads of pins 36.

If desired, a shaping operation such as cutting can be performed with pins 36 remaining in the stack of sheet material, the cutting being guided by the pattern. Typically, pins 36 are moved downwardly vertically through the sheet material to locate the pin heads at or below surface 12. Next, the sheet material is shaped, for example cut by a straight knife machine commercially available from Eastman Machine Company under the designation Blue Streak, by following the pattern. This results in stacks of cut parts or pieces designated 260 in FIG. 1 which can be removed from surface 12. Such removal can be enhanced by applying a positive pressure to the region below the stacks to apply a flotation force in a manner which will be described. Upon conclusion of the foregoing, the pins are moved upwardly through the apertures 30 and then withdrawn therefrom by hand to prepare the table 10 for the next operation.

When it is desired to apply a flotation force to material on table top 12 to facilitate movement therealong, the operator manually actuates a suitable control such as a valve (not shown) to allow positive pressure fluid such as compressed air to flow from the source through pipes 102 and 104 and into the manifolds such as manifold 110 shown in FIGS. 1 and 3 from which the positive pressure fluid is distributed by tubes 116 to the openings 94 and thus between the outer surface 22 of table top 12 and sheet material 280 placed thereon, typically in a stack. This facilitates movement of the material along the surface of table top 12 by the operator. The sealing means 90 prevents loss of the positive pressure fluid through the apertures 30. Typically, a sheet 282 of non-permeable material such as paper or the like is inserted between the stacks 270 and the outer surface of table top 12 to prevent loss of positive pressure fluid in an upward direction through the stack.

By way of example, in an illustrative pin table wherein top 12 is about 96 inches long by about 60 inches wide, openings 30 are arranged in a one inch grid pattern and openings 94 are arranged in an eight inch grid pattern. Table top 12 is of particle board or flake boad material having a thickness of about one inch and is provided with an outer layer of Formica or like material defining surface portion 22. Rubber sheet 90 has a thickness of about one-quarter inch. Each tube 116 has an outer diameter of about 6 mm and an inner diameter of about 4 mm. Pipes 102, 104, 106 are of about four inch diameter, and the air blower operates at 4 psig in a low pressure, high volume mode. With the impervious sheet 262 placed between stacks 260 and table top 12 as previously described, the apparatus has the capability of lifting cloth sheet goods having a weight in excess of 120 pounds measured over an area of 40 square feet.

It is therefore apparent that the present invention accomplished its intended objects. In particular, there is provided a new and improved method and apparatus for supporting and matching patterned sheet material such as cloth in a stack during operations thereon such as cutting. The apparatus is in the form of a new and improved pin table which is economical in manufacture and effective and efficient in operation, and the operations performed using the apparatus result in labor and material savings and improved quality. The apparatus optimizes matching of the grid pattern of the pins to plaid pattern fabrics of any size plaid. In addition, the apparatus has the capability of assisting movemant of the stacked sheet material along the supporting surface.

While an embodiment of the present invention have been described in detail, that is for the purpose of illustration, not limitation.

What is claimed is:

1. Apparatus for supporting sheet material such as cloth during operations such as cutting performed thereon comprising:

a) a supporting frame;

b) means on said frame defining a planar supporting surface adapted to receive plies of sheet material placed thereon, said surface having a plurality of through apertures therein arranged in a pattern on said surface, said surface having an outer portion contacting said material and an oppositely disposed portion;

c) a plurality of pins each disposed substantially perpendicular to the plane of said surface and each location in registry with one of said apertures, each of said pins having a sharp head at one end and an opposite end;

d) a plurality of separate pin holding and supporting means carried by said frame and arranged in rows therealong and facing said oppositely disposed portion of said supporting surface, each of said pin holding and supporting means being of relatively narrow width and having a length extending transversely of said supporting surface and said plurality of holding and supporting means being in closely spaced relation in a direction longitudinally along said supporting surface, said holding and supporting means receiving said pins at said opposite ends thereof and maintaining the disposition of said pins substantially perpendicular to the plane of said surface and the location of said pins in registry with said apertures, each of said pin holding and supporting means including a pair of sidewalls in spaced relation extending along said length and having oppositely facing inner surfaces and defining a trough-like region open toward said portion of said supporting surface;

e) each of said pin holding and supporting means including pin contacting means pivotally movable about an axis substantially parallel to said length between a first position wherein pins are releasably held in said pin holding and supporting means to a second position wherein said pins are firmly clamped in said pin holding and supporting means between said inner facing surfaces of said sidewalls and corresponding opposite surfaces of said pin contacting means, one of said surfaces of said pin contacting means being defined by surface defining means mounted in said pin contacting means for movement toward and away from said axis; and f) means carried by said frame for moving said holding and supporting means to move said pins through said apertures inwardly between a position where the heads of said pins are spaced inwardly from said outer surface portion and a position where said pins extend through said apertures and the heads of said pins are spaced outwardly from said outer surface portion so that said sheet material can be anchored on said pins.

2. Apparatus according to claim 1, wherein said surface defining means is mounted for limited movement.

3. Apparatus according to claim 1 further including resilient means in said pin contacting means against which said surface defining means moves in the pin clamping position.

4. Apparatus according to claim 1, further including means for limiting movement of said defining means in a direction away from said axis.

5. Apparatus for supporting sheet material such as cloth during operations such as cutting performed thereon comprising:

a) a supporting frame;

b) means on said frame defining a planar supporting surface adapted to receive plies of sheet material placed thereon, said surface having a plurality of through apertures therein arranged in a pattern on said surface, said surface having an outer portion contacting said material and an oppositely disposed portion;

c) a plurality of pins each disposed substantially perpendicular to the plane of said surface and each located in registry with one of said apertures, each of said pins having a sharp head at one end and an opposite end;

d) a plurality of separate pin holding and supporting means carried by said frame and arranged in rows therealong and facing said oppositely disposed portion of said supporting surface, each of said pin holding and supporting means being of relatively narrow width and having a length extending transversely of said supporting surface and said plurality of holding and supporting means being in closely spaced relation in a direction longitudinally along said supporting surface, said holding and supporting means receiving said pins at said opposite ends thereof and maintaining the disposition of said pins substantially perpendicular to the plane of said surface and the location of said pins in registry with said apertures, each of said pin holding and supporting means including a pair of sidewalls in spaced relation extending along said length and having oppositely facing inner surfaces and defining a trough-like region open toward said portion of said supporting surface;

e) each of said pin holding and supporting means including pin contacting means pivotally movable about an axis substantially parallel to said length between a first position wherein pins are releasably held in said in holding and supporting means to a second position wherein said pins are firmly clamped in said pin holding and supporting means between said inner facing surfaces of said sidewalls and corresponding opposite surfaces of said pin contacting means, one of said surfaces of said pin contacting means being defined by surface defining means mounted in said pin contacting means for movement toward and away from said axis, said surface defining means comprising a rod having a curved outer surface and disposed substantially parallel to said axis so that a portion of the curved outer surface of said rod bears against said pins; and f) means carried by said frame for moving said holding and supporting means to move said pins through said apertures inwardly between a position where the heads of said pins are spaced inwardly from said outer surface portion and a position where said pins extend through said apertures and the heads of said pins are spaced outwardly from said outer surface portion so that said sheet material can be anchored on said pins.

6. Apparatus for supporting sheet material such as cloth during operations such as cutting performed thereon comprising:

a) a supporting frame;

b) means on said frame defining a planar supporting surface adapted to receive plies of sheet material placed thereon, said surface having a plurality of through apertures therein arranged in a pattern on said surface, said surface having an outer portion contacting said material and an oppositely disposed portion;

c) a plurality of pins each disposed substantially perpendicular to the plane of said surface and each located in registry with one of said apertures, each of said pins having a sharp head at one end and an opposite end;

d) a plurality of separate pin holding and supporting means carried by said frame and arranged in rows therealong and facing said oppositely disposed portion of said supporting surface, each of said pin holding and supporting means being of relatively narrow width and having a length extending transversely of said supporting surface and said plurality of holding and supporting means being in closely spaced relation in a direction longitudinally along said supporting surface, said holding and supporting means receiving said pins at said opposite ends thereof and maintaining the disposition of said pins substantially perpendicular to the plane of said surface and the location of said pins in registry with said apertures, each of said pin holding and supporting means including a pair of sidewalls in spaced relation extending along said length and having oppositely facing inner surface and defining a trough-like region open toward said portion of said supporting surface;

e) each of said pin holding and supporting means including pin contacting means pivotally movable about an axis substantially parallel to said length between a first position wherein pins are releasably held in said pin holding and supporting means to a second position wherein said pins are firmly clamped in said pin holding and supporting means between said inner facing surfaces of said sidewalls and corresponding opposite surfaces of said pin contacting means, one of said surfaces of said pin contacting means being defined by surface defining means mounted in said pin contacting means for movement toward and away from said axis;

f) means defining a curved pin contacting surface opposite said surface defining means; and g) means carried by said frame for moving said holding and supporting means to move said pins through said apertures inwardly between a position where the heads of said pins are spaced inwardly from said outer surface portion and a position where said pins extend through said apertures and the heads of said pins are spaced outwardly from said outer surface portion so that said sheet material can be anchored on said pins.

7. Apparatus according to claim 6, further including a wear resistent coating on said curved pin contacting surface.

* * * * *